US009742121B2

(12) United States Patent
Hayashi et al.

(10) Patent No.: US 9,742,121 B2
(45) Date of Patent: Aug. 22, 2017

(54) ELECTRIC CONNECTOR

(71) Applicant: SMK Corporation, Tokyo (JP)

(72) Inventors: Osamu Hayashi, Kanagawa (JP); Naoyuki Ono, Chiba (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 15/197,725

(22) Filed: Jun. 29, 2016

(65) Prior Publication Data

US 2017/0040747 A1 Feb. 9, 2017

Related U.S. Application Data

(63) Continuation of application No. PCT/JP2015/084865, filed on Dec. 7, 2015.

(30) Foreign Application Priority Data

Aug. 7, 2015 (JP) ..... 2015-156682

(51) Int. Cl.

| | |
|---|---|
| ***H01R 13/6585*** | (2011.01) |
| ***H01R 24/60*** | (2011.01) |
| ***H01R 13/405*** | (2006.01) |
| ***H01R 13/6476*** | (2011.01) |

(52) U.S. Cl.

CPC ..... *H01R 13/6585* (2013.01); *H01R 13/405* (2013.01); *H01R 13/6476* (2013.01); *H01R 24/60* (2013.01)

(58) Field of Classification Search

CPC ..... H01R 13/6585; H01R 43/18; H01R 24/60

See application file for complete search history.

(56) References Cited

U.S. PATENT DOCUMENTS

| | | | | |
|---|---|---|---|---|
| 8,684,769 | B2 * | 4/2014 | Kao | H01R 13/6471 439/607.28 |
| 9,178,319 | B2 * | 11/2015 | Little | H01R 13/6585 |
| 9,214,766 | B1 * | 12/2015 | Yu | H01R 13/6585 |
| 9,231,356 | B1 * | 1/2016 | Ju | H01R 24/78 |
| 9,276,365 | B2 * | 3/2016 | Yu | H01R 24/70 |
| 2005/0048846 | A1 | 3/2005 | Suzuki et al. | |

(Continued)

FOREIGN PATENT DOCUMENTS

JP 2012-221658 A 11/2012

OTHER PUBLICATIONS

International Search Report for International Application No. PCT/JP2015/084865, issued by the Japan Patent Office dated Mar. 8, 2016.

*Primary Examiner* — Briggitte R Hammond

(57) ABSTRACT

An electric connector 1 has: terminals 20 that include connection portions 21 arranged on one surface of a fitting part 50 for connection with a counterpart connector; terminals 30 that include connection portions 31 arranged on a surface opposite to the one surface of the fitting part 50 for connection with the counterpart connector; a plate-like screen plate 10 that is interposed between the first connection portions 21 and the second connection portions 31 of the fitting part 50; and a housing 40 comprises a primary molded portion 41 in which the terminals 30 and the screen plate 10 are integrally provided by insert molding and a secondary molded portion 42 in which the primary molded portion 41 and the terminals 20 are integrally provided by insert molding 42.

8 Claims, 11 Drawing Sheets

(56) References Cited

U.S. PATENT DOCUMENTS

| | | | | |
|---|---|---|---|---|
| 2015/0004839 | A1 | 1/2015 | Wang et al. | |
| 2015/0111436 | A1* | 4/2015 | Zhang | H01R 13/405 439/676 |
| 2015/0222059 | A1* | 8/2015 | Little | H01R 13/6587 439/607.55 |
| 2015/0255911 | A1 | 9/2015 | Kato et al. | |
| 2015/0270661 | A1* | 9/2015 | Kao | H01R 13/5202 439/271 |
| 2015/0325957 | A1* | 11/2015 | Liao | H01R 43/18 439/607.05 |
| 2015/0340791 | A1* | 11/2015 | Kao | H01R 13/42 439/676 |
| 2015/0380868 | A1* | 12/2015 | Chen | H01R 13/6585 439/607.01 |
| 2016/0020572 | A1 | 1/2016 | Ju et al. | |

* cited by examiner

ELECTRIC CONNECTOR

CROSS REFERENCE TO RELATED APPLICATION

The contents of the following Japanese patent application and International patent application are incorporated herein by reference, Japanese Patent Application No. 2015-156682 filed on Aug. 7, 2015, and International Patent Application No. PCT/JP2015/84865 filed on Dec. 7, 2015.

FIELD

The present invention relates to an electric connector that includes a plate-like fitting part to fit a counterpart connector.

BACKGROUND

In recent years, there has been increasing demand for multipolarization of electric connectors mounted in electronic devices in association with more increased and enhanced functions of the electronic devices.

Patent Literature 1 discloses a configuration of a multipolarized electric connector in which contacts are disposed on both sides of a plate-like resin protrusion part. In the electric connector of Patent Literature 1, a large number of contacts are fixed to the protrusion part by insert molding to seal the contacts with an insulating resin while maintaining insulation properties among them.

CITATION LIST

Patent Literature

PATENT LITERATURE 1: Japanese Patent Application Publication No. 2012-221658

SUMMARY

Technical Problems

In the technique of Patent Literature 1, however, there is a problem that, if it is necessary to flow signals at higher transmission rates in association with the more increased and advanced functions of electronic devices, when the signal is flown to a terminal disposed on one side of the protrusion part, noise is generated in a signal flown to a terminal disposed on the other side.

To solve this problem, a metallic screen plate may be provided between the terminal disposed on the one side of the protrusion part and the terminal disposed on the other side of the same to reduce influence of the noise. In this configuration, it is difficult to provide the terminals and the screen plate at the protrusion part by the method described in Patent Literature 1 due to the structure of the molding die. There is a possible method by which the screen plate is integrally molded into the protrusion part and the terminals are press-fitted into the protrusion part. According to this method, however, when the protrusion part is thinner in correspondence with the size reduction or slimming down of the electric connector, the terminals lift up due to a slight dimension error to cause the terminals to be plastically deformed or broken by the insertion or extraction of the counterpart connector.

An object of the present invention is to provide an electric connector formed such that terminals and a screen plate are provided integrally into a housing by insert molding to mold a primary molded portion of the housing and insert molding to mold a secondary molded portion of the housing, thereby to reduce the influence of noise by the screen plate and prevent the plastic deformation or breakage of the terminals.

Solutions to Problems

An electric connector according to an aspect of the present invention includes: an insulating housing that includes a plate-like fitting part to fit to a counterpart connector; a plurality of first conductive terminals that is provided in the housing and has a first connection portion arranged on one surface of the fitting part for connection with the counterpart connector and a first terminal portion protruding from the housing; a plurality of second conductive terminals that is provided in the housing and has a second connection portion arranged on a surface opposite to the one surface of the fitting part for connection with the counterpart connector and a second terminal portion protruding from the housing; a plate-like screen plate that is interposed between the first connection portion and the second connection portion of the fitting part; and a shield member that is attached to the housing. The housing comprises a primary molded portion in which the plurality of first terminals and the screen plate are integrally provided by insert molding and a secondary molded portion in which the primary molded portion and the plurality of second terminals are integrally provided by insert molding.

By providing the first terminals and the screen plate integrally into the primary molded portion by insert molding and then providing the primary molded portion and the second terminals integrally into the secondary molded portion by insert molding, it is possible to interpose the screen plate between the first connection portion and the second connection portion, and provide the first connection portion, the second connection portion, and the screen plate integrally in the plate-like fitting part without press-fitting the first terminals and the second terminals into the housing, thereby to prevent the lifting of the terminals from the fitting part.

According to the aspect of the present invention, the insert molding for molding the primary molded portion of the housing and the insert molding for molding the secondary molded portion of the housing are performed to provide the terminals and the screen plate integrally into the housing, thereby making it possible to reduce the influence of noise by the screen plate and prevent the plastic deformation and breakage of the terminals.

DESCRIPTION OF EMBODIMENTS

Figure 1:
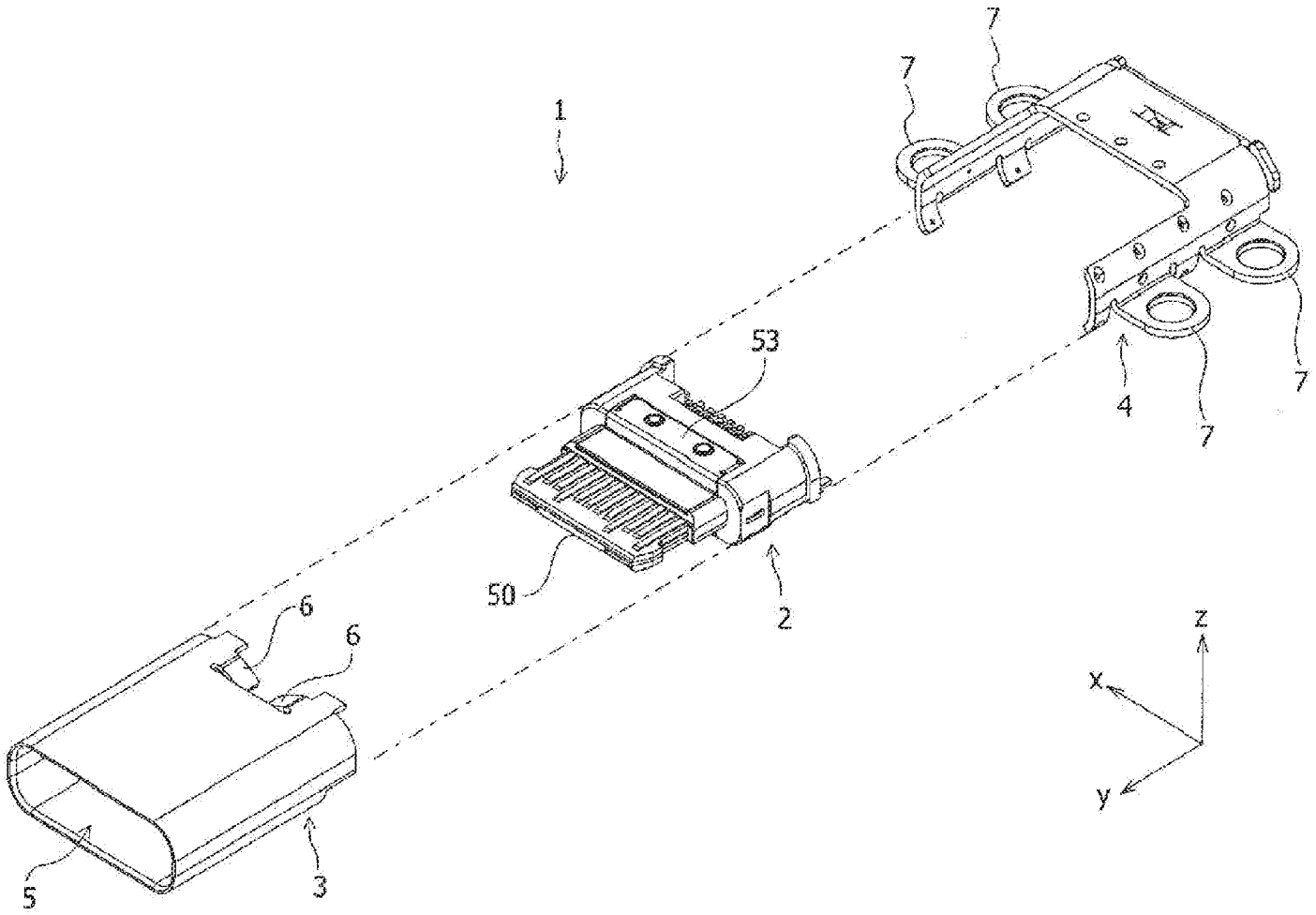
FIG. 1 is an exploded perspective view of an electric connector according to an embodiment of the present invention.

An electric connector according to an embodiment of the present invention will be described below in detail with reference to the drawings. In the drawings, x axis, y axis, and z axis form a triaxial orthogonal coordinate system. In the following description, the positive direction of the y axis is defined as forward direction, the negative direction of the y axis as backward direction, the direction of the x axis as lateral direction, the positive direction of the z axis as upward direction, and the negative direction of the z axis as downward direction.

<Configuration of the Electric Connector>

Figure 2:
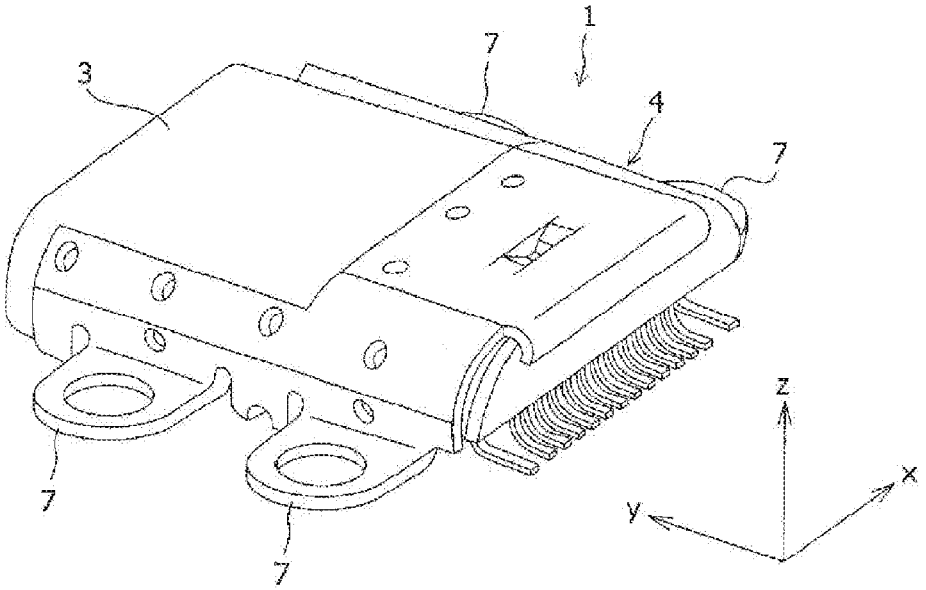
FIG. 2 is a perspective view of the electric connector according to the embodiment of the present invention.
Figure 3:
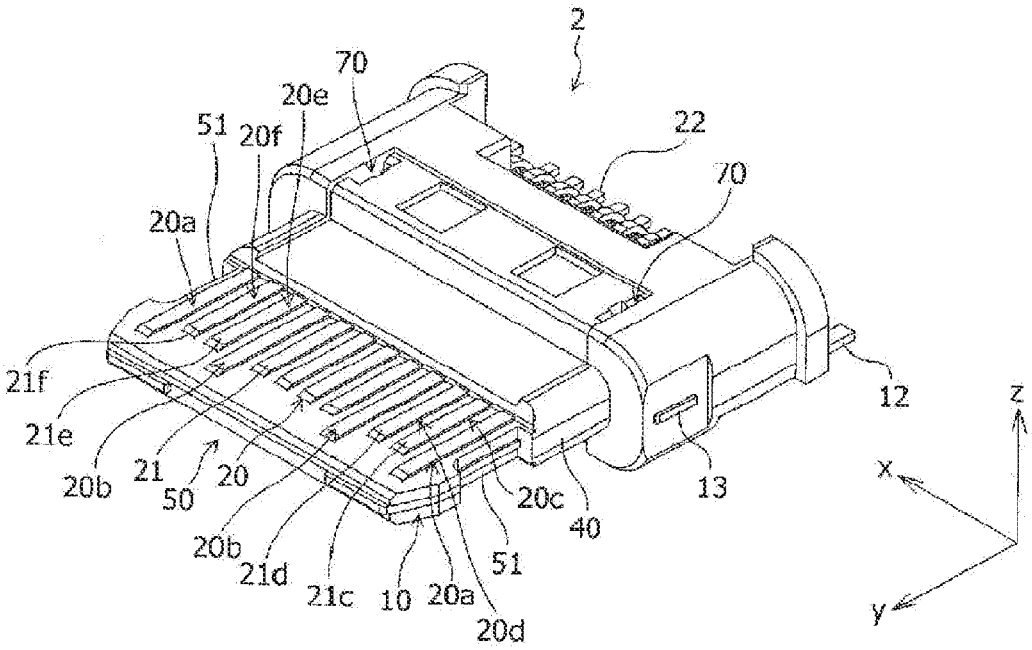
FIG. 3 is a perspective view of a main body part seen from the diagonally upper front side according to the embodiment of the present invention.
Figure 4:
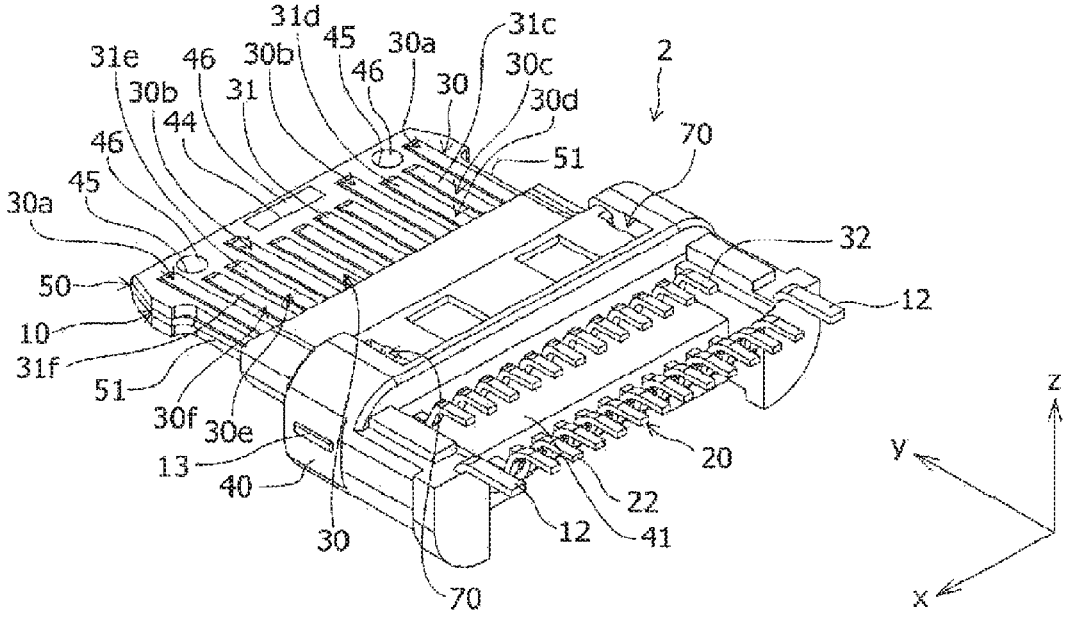
FIG. 4 is a perspective view of the main body part seen from the diagonally upper back side according to the embodiment of the present invention.
Figure 5:
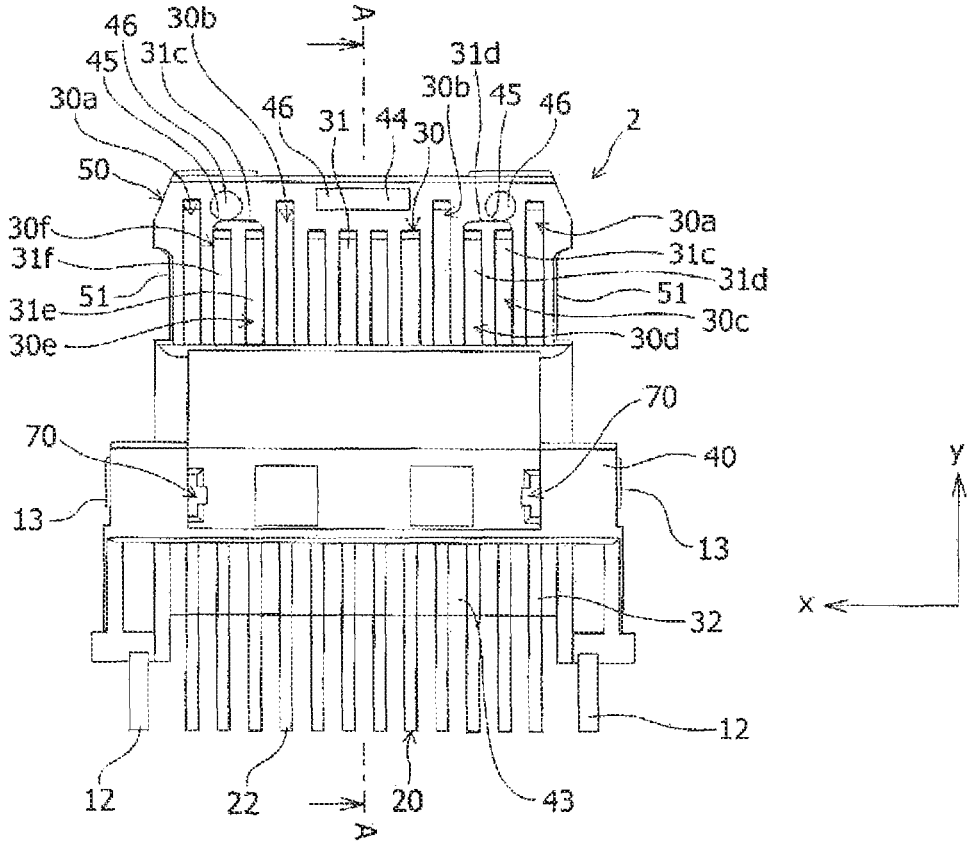
FIG. 5 is a plane view of the main body part according to the embodiment of the present invention.
Figure 6:
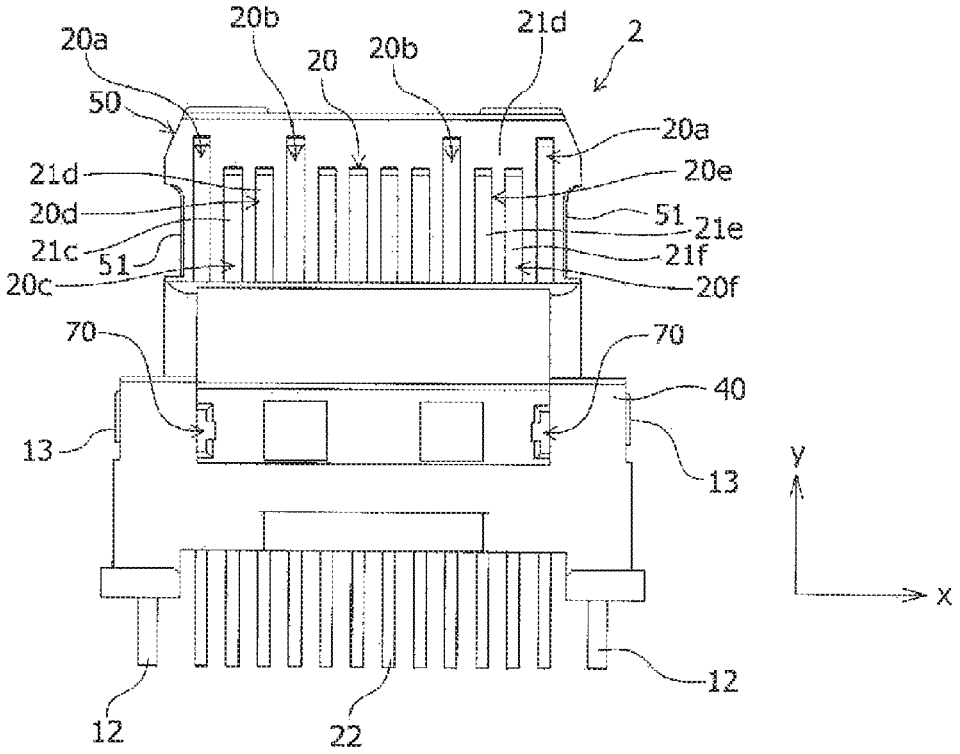
FIG. 6 is a bottom view of the main body part according to the embodiment of the present invention.
Figure 7:
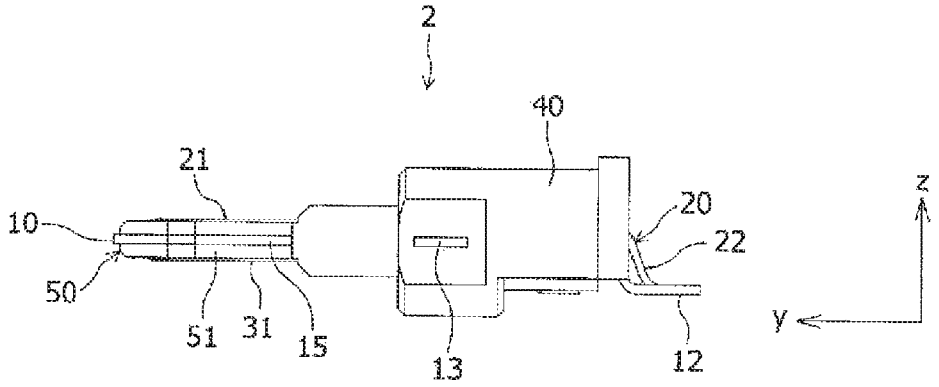
FIG. 7 is a side view of the main body part according to the embodiment of the present invention.
Figure 8:
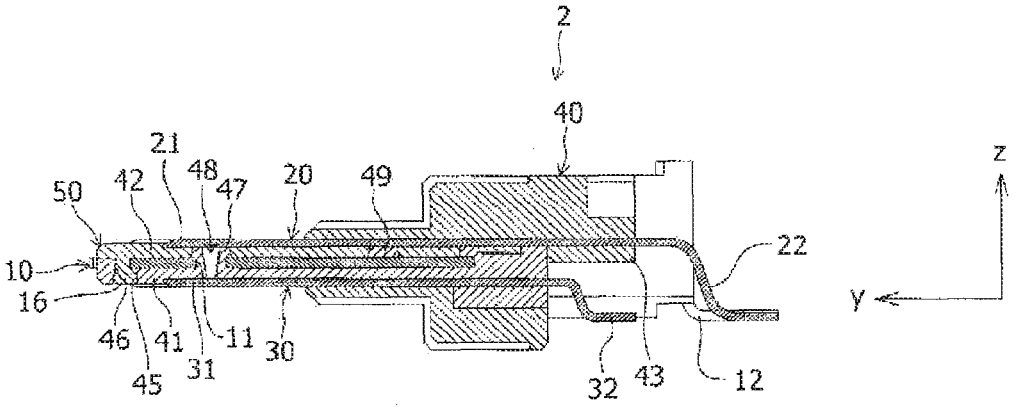
FIG. 8 is a cross-sectional view of FIG. 5 taken along line A-A.

The configuration of an electric connector 1 according to an embodiment of the present invention will be described below in detail with reference to FIGS. 1 and 2.

The electric connector 1 includes a main body part 2, an inner shield member 3, and an outer shield member 4.

An EMI pad 53 is press-fitted into the main body part 2. The main body part 2 is covered with the inner shield member 3 and the outer shield member 4. The configuration of the main body part 2 will be described later in detail.

The inner shield member 3 has a cylindrical shape opened at the front and back sides, covers the front side of the main body part 2, and has the back side stored in the outer shield member 4. The inner shield member 3 lets a fitting part 50 of the main body part 2 exposed to the outside through a front opening 5. The inner shield member 3 has a lock portion 6 folded downward at the back side. The lock portion 6 locks the inner shield member 3 in the main body part 2 such that the inner shield member 3 does not come off the main body part 2. The inner shield member 3 is connected to the EMI pad 53 of the main body part 2.

The outer shield member 4 covers the back side of the main body part 2. The outer shield member 4 connects to the inner shield member 3. The outer shield member 4 has a plurality of leg portions 7 protruding at the sides. The leg portions 7 are connected by soldering or the like to a ground of a substrate not illustrated.

<Configuration of the Main Body Part>

A configuration of the main body part 2 according to the embodiment of the present invention will be described below in detail with reference to FIGS. 3 to 12. FIGS. 3 to 6 do not illustrate the EMI pad 53.

The main body part 2 has a screen plate 10, terminals 20, terminals 30, and a housing 40.

The screen plate 10 is formed from a metallic material in a plate-like shape and is provided in the housing 40. The screen plate 10 is interposed between the terminals 20 and the terminals 30 at a fitting part 50 of the housing 40. The screen plate 10 has through holes 16 that penetrate in a thickness direction (vertical direction) at the front side and a plurality of through holes 11 that penetrates in the thickness direction at the front side and is spaced in a lateral direction, and a plurality of through holes 14 that penetrates in the thickness direction at the back side and is spaced in the lateral direction (see FIGS. 11 and 12).

Figure 10:
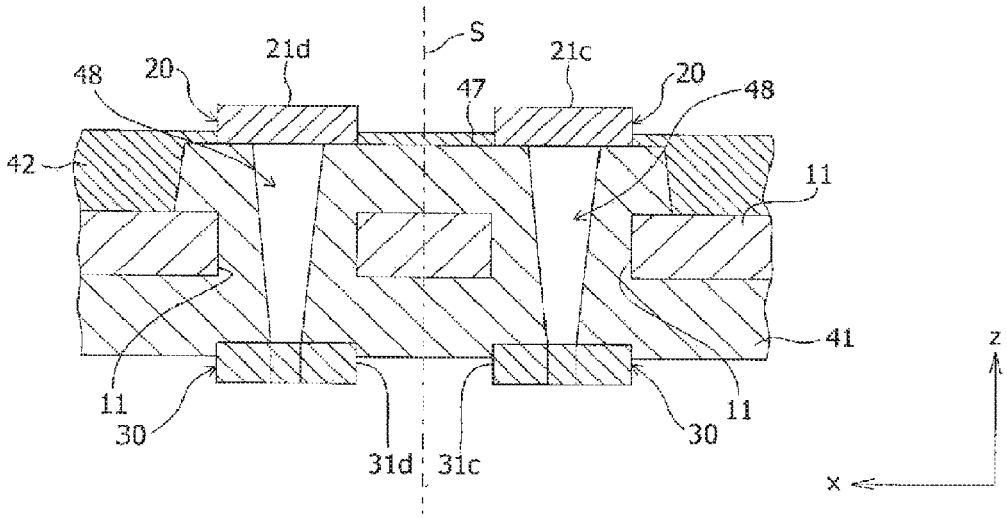
FIG. 10 is an enlarged perspective view of part of the main body part according to the embodiment of the present invention.
Figure 11:
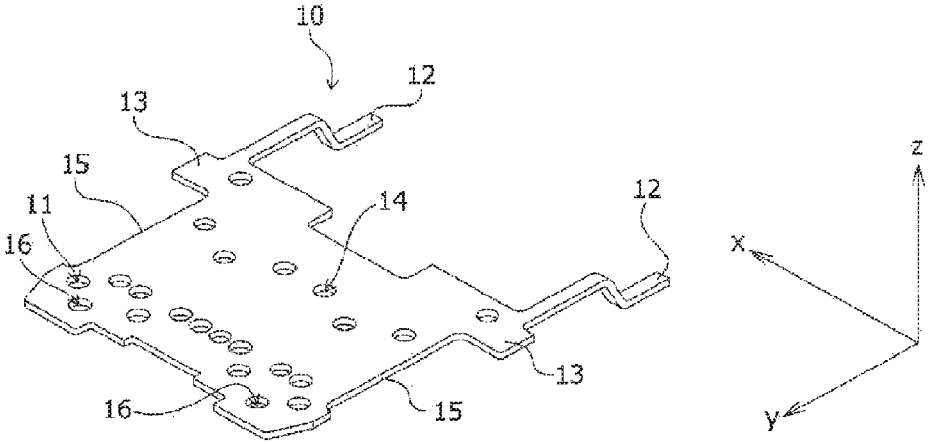
FIG. 11 is a perspective view of a screen plate according to the embodiment of the present invention.
Figure 12:
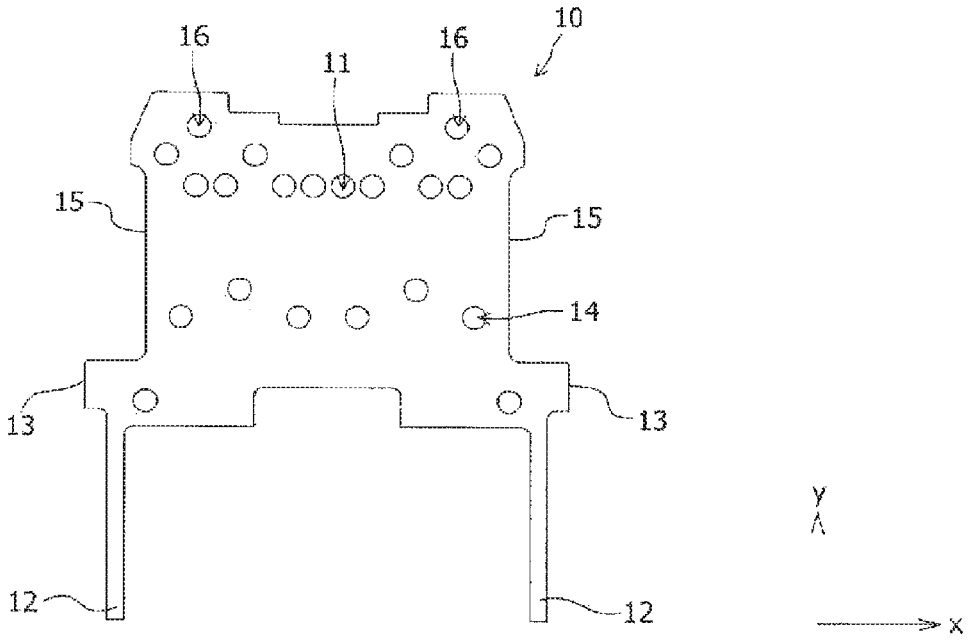
FIG. 12 is a plane view of the screen plate according to the embodiment of the present invention.

As illustrated in FIG. 10, the through hole 11 blocked by a connection portion 21*c* of a high-speed transmission terminal 20*c* and a connection portion 31*c* of a high-speed transmission terminal 30*c* and the through hole 11 blocked by a connection portion 21*d* of a high-speed transmission terminal 20*d* and a connection portion 31*d* of a high-speed transmission terminal 30*d* described later are symmetric with respect to a virtual plane S. The virtual plane S is a plane parallel to the thickness direction and orthogonal to the direction of arrangement of the connection portions 21 and the connection portions 31 (lateral direction). The foregoing matter also applies to the through hole 11 blocked by a connection portion 21*e* of a high-speed transmission terminal 20*e* and a connection portion 31*e* of a high-speed transmission terminal 30*e* and the through hole 11 blocked by a connection portion 21*f* of a high-speed transmission terminal 20*f* and a connection portion 31*f* of a high-speed transmission terminal 30*f*, although not illustrated.

The screen plate 10 is provided with a pair of leg portions 12 that protrudes to the back side of the housing 40 and connects to a conductive portion of the substrate not illustrated. The leg portions 12 are provided on the outside of the terminals 20 and the terminals 30 in the lateral direction. The screen plate 10 is provided with a pair of shoulder portions 13 protruding in the lateral direction. The shoulder portions 13 protrude from the side surfaces of the housing 40 and connect to the inner wall of the inner shield member 3. The screen plate 10 has inwardly recessed concave portions 15 on the right and left side surfaces that come into convex-concave fit with the lock part of the counterpart connector to bring the counterpart connector into the lock state. The concave portions 15 constitute concave portions 51 of the fitting part 50 described later.

The terminals 20 as second terminals are formed from a conductive material and provided integrally into the housing 40 by insert molding. The terminals 20 include connection portions 21 as second connection portions that are exposed on the upper surface of the fitting part 50 as one surface and connect to the counterpart connector not illustrated and terminal portions 22 as second terminal portions that protrude from the back side of the housing 40 and connect to the conductive portion of the substrate not illustrated. The connection portions 21 are spaced from each other in the lateral direction on the upper surface of the fitting part 50. The connection portions 21 block the upper side of the through holes 48 provided in a primary molded portion 41 (see FIG. 8).

The terminals 20 include forwardly protruding power supply minus terminals 20*a* (for example, GND) and power supply plus terminal 20*b* (for example, VBUS). The power supply minus terminals 20*a* are arranged on the outermost sides in the lateral direction.

The terminals 20 include the high-speed transmission terminal 20*c* (for example, RX2+), the high-speed transmission terminal 20*d* (for example, RX2−), the high-speed transmission terminal 20*e* (for example, TX1−), and the high-speed transmission terminal 20*f* (for example, TX1+). The speed equal to or faster than a predetermined speed is 5 Gbps. which are used to transmit signals at a predetermined speed or faster, for example. The pair of high-speed transmission terminal 20*c* and high-speed transmission terminal 20*d* conducts differential transmission of signals by the voltage difference between the terminal 20*c* and the terminal 20*d*. The pair of high-speed transmission terminal 20*e* and high-speed transmission terminal 20*f* conducts differential transmission of signals by the voltage difference between the terminal 20*e* and the terminal 20*f*.

Figure 9:
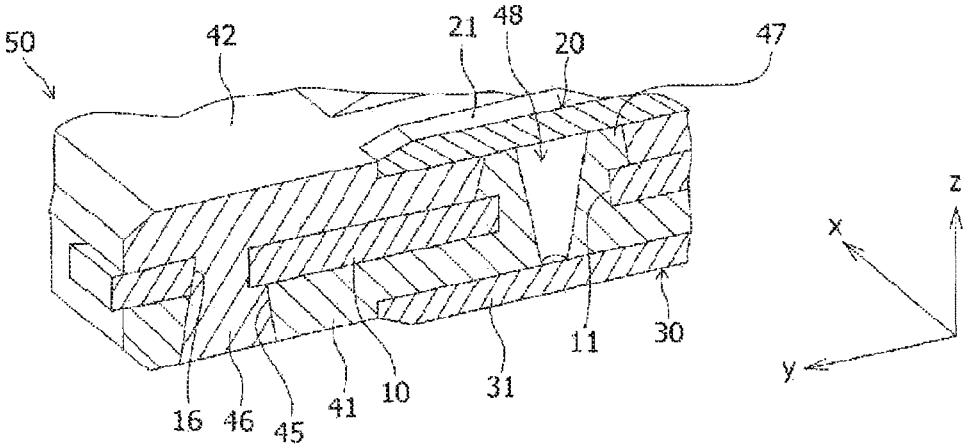
FIG. 9 is an enlarged perspective view of part of the main body part according to the embodiment of the present invention.

The connection portions 21 block the upper side of the through holes 48 as illustrated in FIG. 9. The pair of the connection portion 21*c* of the high-speed transmission terminal 20*c* and the connection portion 21*d* of the high-speed transmission terminal 20*d* is symmetric with respect to the virtual plane S as illustrated in FIG. 10. Although not illustrated, the pair of the connection portion 21*e* of the high-speed transmission terminal 20*e* and the connection portion 21*f* of the high-speed transmission terminal 20*f* is positioned in the same way as the connection portion 21*c* and the connection portion 21*d*.

The terminals 30 as first terminals are formed from a conductive material and provided integrally into the housing 40 by insert molding. The terminals 30 include connection portions 31 as first connection portions that are exposed on the lower surface opposite to the one surface of the fitting part 50 and connect to the counterpart connector not illustrated and terminal portions 32 as first terminal portions that protrude from the back side of the housing 40 and connect to the conductive portion of the substrate not illustrated. The connection portions 31 are spaced from each other in the lateral direction on the lower surface of the fitting part 50. The connection portions 31 block the lower side of the through holes 11 of the screen plate 10. The connection portions 31 are opposed to the connection portions 21 through the through holes 11 and the through holes 48.

The terminals 30 include forwardly protruding power supply minus terminals 30*a* (for example, GND) and power supply plus terminals 30*b* (for example, VBUS). The power supply minus terminals 30*a* are arranged at the outermost sides in the lateral direction.

The terminals 30 include the high-speed transmission terminal 30*c* (for example, TX2+), the high-speed transmission terminal 30*d* (for example, TX2−), the high-speed transmission terminal 30*e* (for example, RX1−), and the high-speed transmission terminals 30*f* (for example, RX1+) that are used to transmit signals at a predetermined speed or faster. The pair of high-speed transmission terminal 30*c* and high-speed transmission terminal 30*d* conducts differential transmission of signals by the voltage difference between the terminal 30*c* and the terminal 20*d*. The pair of high-speed transmission terminal 30*e* and high-speed transmission terminal 30*f* conducts differential transmission of signals by the voltage difference between the terminal 30*e* and the terminal 30*f*.

The connection portions 31 overlap the connection portions 21 in the vertical direction. The connection portions 31 block the lower side of the through holes 48 as illustrated in FIG. 9. The pair of the connection portion 31*c* of the high-speed transmission terminal 30*c* and the connection portion 31*d* of the high-speed transmission terminal 30*d* is symmetric with respect to the virtual plane S as illustrated in FIG. 10. Although not illustrated, the pair of the connection portion 31*e* of the high-speed transmission terminal 30*e* and the connection portion 31*f* of the high-speed transmission terminal 30*f* is positioned in the same way as the connection portion 31*c* and the connection portion 31*d*.

The screen plate 10, the terminals 20, and the terminals 30 are formed by folding and bending their respective metallic materials such that abutment surfaces of the terminal portions 32 relative to the substrate, abutment surfaces of the terminal portions 22 relative to the substrate, and abutment surfaces of the leg portions 12 relative to the substrate are flush with one another.

The power supply minus terminal 20*a* and the power supply minus terminal 30*a* are opposed to each other via the through hole 48. The power supply plus terminal 20*b* and the power supply plus terminal 30*b* are opposed to each other via the through hole 48. The connection portion 21*c* of the high-speed transmission terminal 20*c* and the connection portion 31*c* of the high-speed transmission terminal 30*c* are of the same polarity and are opposed to each other via the through hole 48. The connection portion 21*d* of the high-speed transmission terminal 20*d* and the connection portion 31*d* of the high-speed transmission terminal 30*d* are of the same polarity and are opposed to each other via the through hole 48. The connection portion 21*e* of the high-speed transmission terminal 20*e* and the connection portion 31*e* of the high-speed transmission terminal 30*e* are of the same polarity and are opposed to each other via the through hole 48. The connection portion 21*f* of the high-speed transmission terminal 20*f* and the connection portion 31*f* of the high-speed transmission terminal 30*f* are of the same polarity and are opposed to each other via the through hole 48. In this manner, the terminals for the same purpose and of the same polarity are opposed to each other via the through hole 48.

The housing 40 is formed from an insulating material. The housing 40 includes the plate-like fitting part 50 to fit the counterpart connector not illustrated. The fitting part 50 has the inwardly recessed concave portions 51 on the right and left side surfaces that come into convex-concave fit with the lock portion of the counterpart connector to bring the counterpart connector into the lock state. The housing 40 is provided with a bulkhead portion 43 in which the terminals 20 are embedded so as not to be opposed to the terminals 30 (see FIG. 8).

The housing 40 comprises a primary molded portion 41 where the plurality of terminals 20 and the screen plate 10 are integrally provided by insert molding and a secondary molded portion 42 where the primary molded portion 41 and the plurality of terminals 30 are integrally provided by insert molding.

The primary molded portion 41 has a through hole 44 that penetrates vertically and has a rectangular shape as seen from above and through holes 45 that penetrate vertically and have a circular shape as seen from above. The primary molded portion 41 is provided with a pedestal portion 47 that passes through the through holes 11 and protrudes upward in a direction away from the connection portions 31. The pedestal portion 47 is provided with through holes 48 that pass through the primary molded portion 41 in the thickness direction (see FIG. 8). The through holes 48 are smaller in diameter than the through holes 11. The connection portions 21 are placed on the pedestal portion 47. The primary molded portion 41 is provided with a pedestal portion 49 that passes through the through holes 14 and protrudes upward in a direction away from the connection portions 31 at a position corresponding to the pedestal portion 47 in the front-back direction. The pedestal portion 49 blocks the through holes 14 (see FIG. 8). The connection portions 21 are placed on the pedestal portion 49.

The secondary molded portion 42 has a burr preventive portion 46 that fits in the through hole 44 and the through hole 45. The burr preventive portion 46 passes through the through holes 16 and blocks the through hole 45. The burr preventive portion 46 passes through the through hole 16 and fills the portions around the through holes 16 of the screen plate 10 (see FIG. 9). The burr preventive portion 46 has an inversely tapered shape in which its width or diameter becomes larger in the downward direction, and fits in the primary molded portion 41.

The housing 40 has a press-fit hole 60 for press-fitting the EMI pad 53.

<Method of Manufacturing the Electric Connector>

A method of manufacturing the electric connector 1 according to the embodiment of the present invention will be described below in detail with reference to FIGS. 13 to 18.

Figure 15:
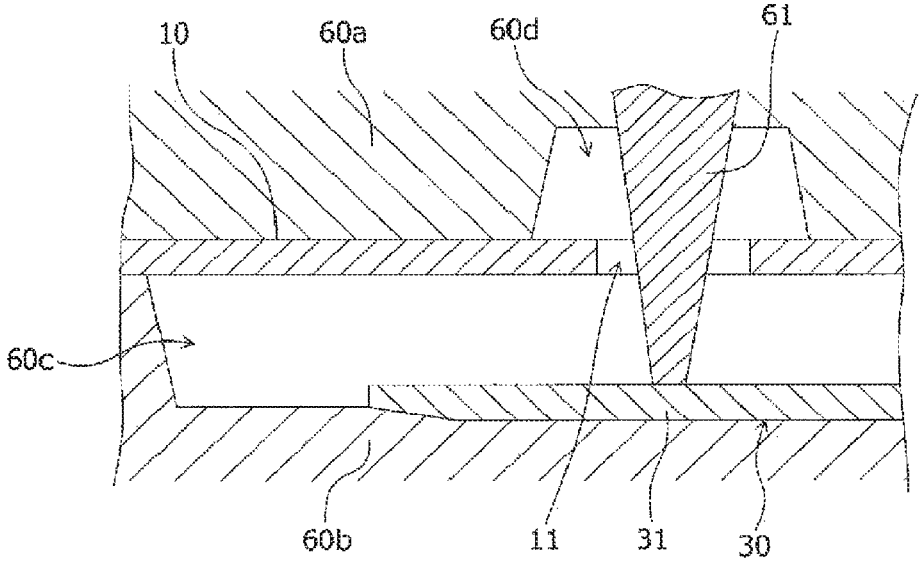
FIG. 15 is a cross-sectional view illustrating a method for molding the primary molded portion according to the embodiment of the present invention.

First, as illustrated in FIG. 15, the screen plate 10 and the terminals 30 are set in an upper molding die 60*a* and a lower molding die 60*b* respectively, fixing pins 61 are inserted into the through holes 11 of the screen plate 10 from above, and the connection portions 31 of the terminals 30 are pressed from above by the fixing pins 61 to fix the connection portions 31 to the lower molding die 60*b*. The outer diameter of the fixing pins 61 is smaller than the inner diameter of the through holes 11, and thus gaps are produced between the fixing pins 61 and the screen plate 10 in the through holes 11.

Figure 13:
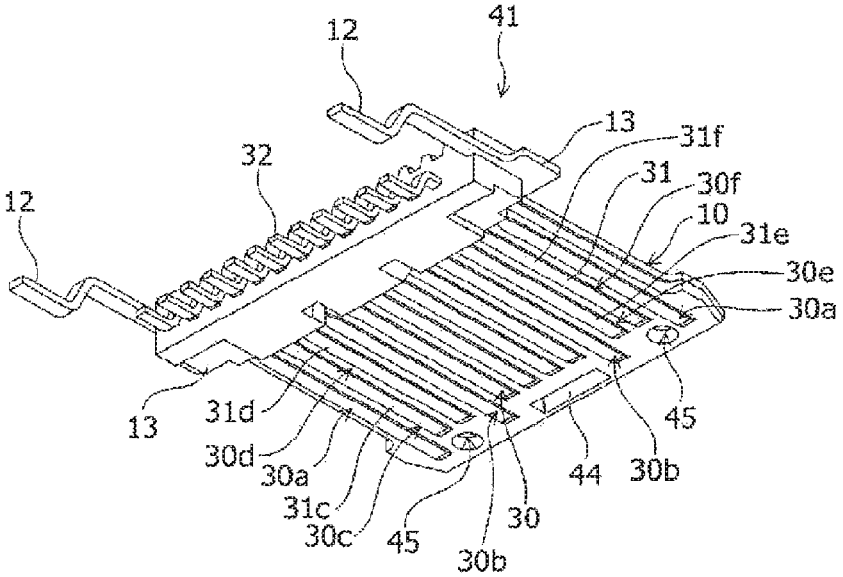
FIG. 13 is a perspective view of a primary molded portion seen from the diagonally lower back side according to the embodiment of the present invention.
Figure 14:
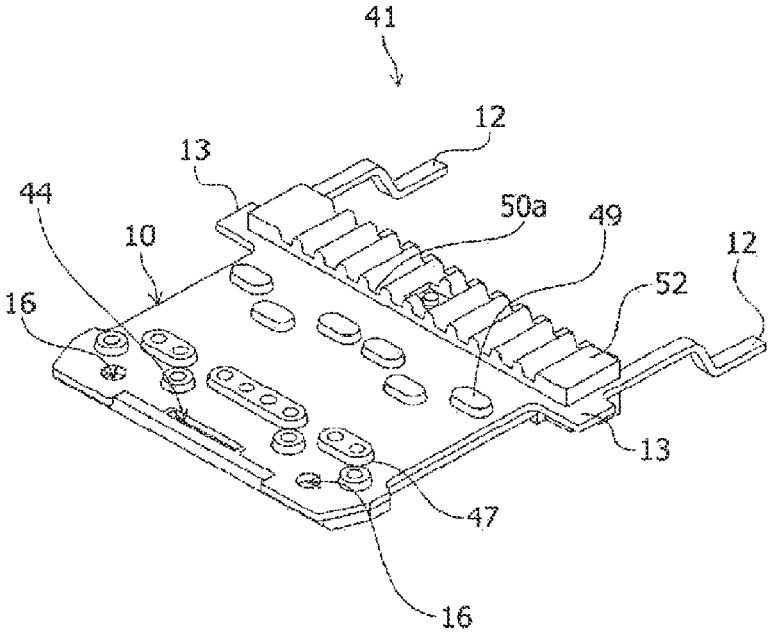
FIG. 14 is a perspective view of the primary molded portion seen from the diagonally upper front side according to the embodiment of the present invention.

Next, insert molding is performed to put a molten resin into a cavity 60*c* formed by the upper molding die 60*a* and the lower molding die 60*b* and solidify the resin, thereby forming the primary molded portion 41 in which the screen plate 10 and the terminals 30 are integrally provided as illustrated in FIGS. 13 and 14. In the primary molded portion 41, the connection portions 31 of the terminals 30 block the lower side of the through holes 48.

At the time of formation of the primary molded portion 41, the molten resin flows from the cavity 60*c* into a cavity 60*d* through the gaps between the screen plate 10 and the fixing pins 61 in the through holes 11, and the resin having flown into the cavity 60*d* solidifies in a bulging state above and around the through holes 11 on the upper surface of the screen plate 10. Accordingly, the pedestal portion 47 is formed as illustrated in FIG. 14. In addition, although not illustrated, the molten resin flows from the cavity 60*c* onto the upper surface of the screen plate 10 through the through holes 14 to block the through holes 14, and solidifies in a bulging state above and around the through holes 14. Accordingly, the pedestal portion 49 is formed as illustrated in FIG. 14. In addition, as illustrated in FIGS. 13 and 14, a positioning portion 52 is formed at the back end of the screen plate 10 to position the terminals 20.

Figure 17:
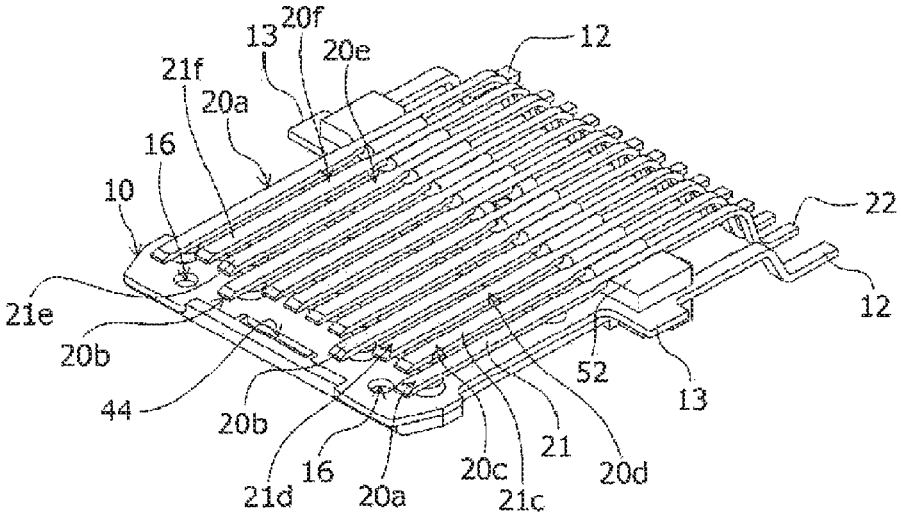
FIG. 17 is a perspective view of a secondary molded portion with terminals integrally provided relative to the primary molded portion seen from the diagonally upper front side according to the embodiment of the present invention.

The positioning portion 52 has a plurality of concave portions 52*a*. The pedestal portion 47, the pedestal portion 49, and the concave portions 52*a* are linearly aligned with one another in the front-back direction. Accordingly, by placing the terminals 20 on the pedestal portion 47 and the pedestal portion 49 and storing the terminals 20 in the concave portions 52*a* as illustrated in FIG. 17, the terminals 20 can be arranged at spaces therebetween in the lateral direction.

Further, the primary molded portion 41 has the through hole 44 and the through holes 45.

Next, the carrier portions connecting integrally the plurality of terminals 30 are cut to separate the plurality of terminals 30, and then the terminals 30 are bent to form the terminal portions 22.

After the solidification of the resin having flown into the cavity 60*c* and the cavity 60*d*, the fixing pins 61 are extracted. The through holes 48 are formed in the primary molded portion 41 by the extraction of the fixing pins 61.

Figure 16:
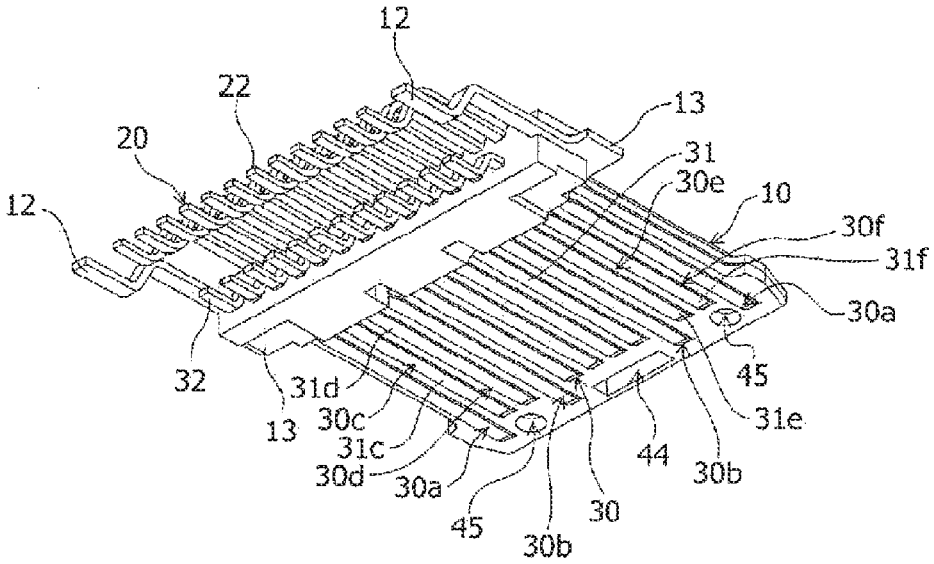
FIG. 16 is a perspective view of the primary molded portion with terminals seen from the diagonally lower back side according to the embodiment of the present invention.
Figure 18:
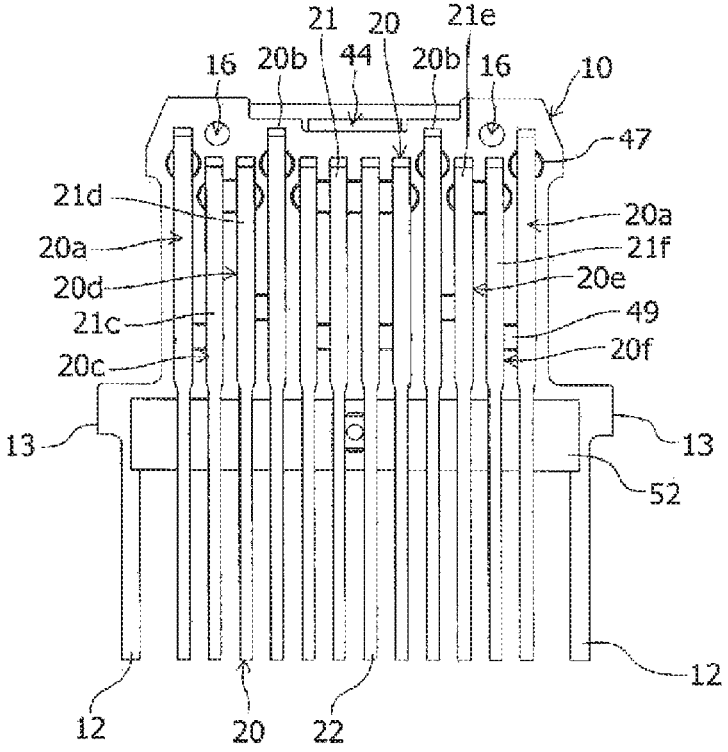
FIG. 18 is a plane view of the secondary molded portion with the terminals integrally provided relative to the primary molded portion according to the embodiment of the present invention.

Next, as illustrated in FIGS. 16 to 18, the connection portions 21 of the terminals 20 are placed on the pedestal portion 47, the pedestal portion 49, and the concave portions 52*a* of the positioning portion 52. As described above, by performing insert molding with the connection portions 31 supported by at least the two pedestal portions 47 and 49 and the concave portions 52*a*, the terminals 20 can be produced in a stable and steady manner. In addition, the pedestal portion 47 and the pedestal portion 49 can be set as marks for positioning the terminals 20, and the pedestal portion 47 and the pedestal portion 49 can be used to position the terminals 20.

Next, insert molding is performed to form the secondary molded portion 42 in which the primary molded portion 41 and the terminals 20 are integrally provided. At that time, the molten resin flows from the upper side to the lower side of the screen plate 10 through the through holes 16, the through hole 44, and the through holes 45 to form the burr preventive portion 46. By forming the secondary molded portion 42 through insert-molding, the inversely-tapered burr preventive portion 46 can be formed. By embedding the portions around the through holes 16 of the screen plate 10 in the burr preventive portion 46, the screen plate 10 can be firmly fixed to the fitting part 50. In the secondary molded portion 42, the connection portions 21 of the terminals 20 block the upper side of the through holes 48.

Next, the carrier portions connecting integrally the plurality of terminals 20 are cut to separate the plurality of terminals 20, and then the terminals 20 are bent to form the terminal portions 22.

Next, the EMI pad 53 is press-fitted into the main body part 2. Accordingly, the main body part 2 illustrated in FIGS. 3 to 9 is completed. Next, the inner shield member 3 is inserted into the main body part 2 from the front side. At that time, the lock portion 6 of the inner shield member 3 is not folded downward.

Next, the lock portion 6 of the inner shield member 3 is folded downward and locked in the main body part 2 to fix the inner shield member 3 to the main body part 2. In addition, the inner shield member 3 and the EMI pad 53 of the main body part 2 are connected together by spot welding or the like.

Next, the outer shield member 4 is inserted into the main body part 2 from the back side and attached to the main body part 2.

Next, the inner shield member 3 and the outer shield member 4 are connected and fixed to each other by spot welding or the like. Accordingly, the electric connector 1 is completed.

The electric connector 1 manufactured in the manner described above is mounted on the substrate by connecting the leg portions 7 of the outer shield member 4 and the leg portions 12 of the screen plate 10 to the ground of the substrate and by connecting the terminal portions 22 and the terminal portions 32 to the conductive portion of the substrate.

In the electric connector 1 mounted on the substrate, first, the power supply minus terminal 20*a*, the power supply plus terminal 20*b*, the power supply minus terminal 30*a*, and the power supply plus terminal 30*b* are each connected to counterpart connector, and then the terminals 20 and the terminals 30 other than the foregoing terminals are each connected to the counterpart connector. In addition, in the electric connector 1 mounted on the substrate, first, the terminals 20 and the terminals 30 other than the terminal 20*a*, the terminal 20*b*, the terminal 30*a*, and the terminal 30*b* are disconnected from the counterpart connector, and then the terminal 20*a*, the terminal 20*b*, the terminal 30*a*, and the terminal 30*b* are disconnected from the counterpart connector.

In this manner, according to the embodiment, the housing 40 comprises the primary molded portion 41 in which the terminals 20 and the screen plate 10 are integrally provided by insert molding and the secondary molded portion 42 in which the primary molded portion 41 and the terminals 30 are integrally provided by insert molding, whereby it is possible to reduce the influence of noise by the screen plate and prevent plastic deformation or breakage of the terminals.

According to the embodiment, the screen plate 10 includes the through holes 11 penetrating in the thickness direction, the fitting part 50 includes the through holes 48 penetrating in the thickness direction via the through holes 11, the connection portions 21 block one side of the through holes 48 in the thickness direction, and the connection portions 31 block the other side of the through holes 48 in the thickness direction. Accordingly, it is possible to prevent such a problem as a short circuit of the connection portions 21 and the connection portions 31 due to entry of a foreign object such as a metallic piece or water into the through holes 48.

According to the embodiment, the openings formed by extracting the fixing pins 61 from the terminals 30 are used as the through holes 48 at the time of the insert molding for integrating the terminals 30 into the primary molded portion 41. This makes it possible to fix the terminals 30 at the time of insert molding and prevent such a problem after the insert molding as a short circuit of the connection portions 21 and the connection portions 31 due to entry of a foreign object such as a metallic piece or water into the through holes 48.

According to the embodiment, the terminals 20 or the terminals 30 include the pair of high-speed transmission terminal 20*c* and high-speed transmission terminal 20*d*, the pair of high-speed transmission terminal 20*e* and high-speed transmission terminal 20*f*, the pair of high-speed transmission terminal 30*c* and high-speed transmission terminal 30*d*, and the pair of high-speed transmission terminal 30*e* and high-speed transmission terminal 30*f* that transmit signals at a predetermined speed or faster. The connection portions of the pairs of high-speed transmission terminals are symmetric with respect to the virtual plane S in parallel to the thickness direction and orthogonal to the direction of arrangement of the connection portions 21 and the connection portions 31. The through holes 11 are symmetric with respect to the virtual plane S to equalize the positional relationship between one connection portion of the pair of high-speed transmission terminals and the through hole 11 and the positional relationship between the other connection portion of the pair of high-speed transmission terminals and the through hole 11. This makes it possible to equalize the impedance between the one connection portion of the pair of high-speed transmission terminals and the screen plate 10 and the impedance between the other connection portion of the pair of high-speed transmission terminals and the screen plate 10. Accordingly, the impedance between the connection portion of one of the pair of high-speed transmission terminals and the screen plate 10 and the impedance between the connection portion of the other of the pair of high-speed transmission terminals and the screen plate 10 become symmetric to improve resistance to exogenous noise and reduce unnecessary radiation noise. This provides favorable electric characteristics of signals flowing in the pair of high-speed transmission terminals.

According to the embodiment, by providing the secondary molded portion 42 with the inversely-tapered burr preventive portion 46 to fit the primary molded portion 41, it is possible to prevent the secondary molded portion 42 from having burrs due to repeated connection with the counterpart connector.

According to the embodiment, the concave portions 51 to come into a convex-concave fit with the lock portion of the counterpart connector are formed by the use of the concave portions 15 in the metallic screen plate 10, thereby improving the strength of the lock mechanism relative to the counterpart connector.

According to the embodiment, the screen plate 10 formed from a metallic material is provided between the connection portions 21 and the connection portions 31 of the plate-like fitting part 50. This allows the screen plate 10 to serve as the member for suppressing noise, the member for adjusting the impedance, and the member for reinforcing the fitting part 50.

According to the embodiment, the terminals for the same purpose and of the same polarity are opposed to each other via the through holes 48. Accordingly, even when a foreign object such as a metallic piece or water enters into the through holes 48, electrical failure can be minimized.

The present invention is not limited to the foregoing embodiment in the kinds, arrangements, numbers, and the like of the members. As a matter of course, the present invention can be modified as appropriate, without deviating from the gist of the invention, by replacing some components with others producing the same advantageous effects or the like.

Specifically, although the primary molded portion 41 is provided with the through holes 48 through which the connection portions 21 and the connection portions 31 are opposed to each other in the foregoing embodiment, the through holes 48 may be filled with the secondary molded portion 42 such that the connection portions 21 and the connection portions 31 are not opposed to each other. In this case, concave grooves may be formed around the through holes 48 in the upper surface of the fitting part 50 in such a manner as to communicate with the through holes 48 and protrude in the lateral direction from the connection portions 21 of the terminals 20 so that, at the time of insert molding of the secondary molded portion 42, a molten resin is put into the through holes 48 from the concave grooves to fill the through holes 48 with the resin. This makes it possible to eliminate such a problem as a short circuit of the connection portions 21 and the connection portions 31 due to entry of a foreign object such as a metallic piece or water into the through holes 48.

In the foregoing embodiment, both the terminals 20 and the terminals 30 are provided with the high-speed transmission terminals, the power supply minus terminals, and the power supply plus terminals. Alternatively, either one of the terminals 20 and the terminals 30 may be provided with the high-speed transmission terminals, the power supply minus terminals, and the power supply plus terminals.

In the embodiment, the connection portions 21 of the terminals 20 or the connection portions 31 of the terminals 30 vary in length in the front-back direction depending on the timing for contact with the counterpart connector. Alternatively, the connection portions 21 or the terminals 30 may be uniform in length in the front-back direction.

In the foregoing embodiment, the power supply minus terminals are arranged at the outermost sides, and the high-speed transmission terminals are arranged between the power supply minus terminals and the power supply plus terminals. Alternatively, the arrangement of these terminals may be changed as appropriate.

In the foregoing embodiment, the screen plate 10 has the leg portions 12. Alternatively, the screen plate 10 may not have the leg portions 12.

In the foregoing embodiment, the shield member comprises two members, the inner shield member 3 and the outer shield member 4. Alternatively, the shield member may comprise one member.

In the foregoing embodiment, the through holes 48 are smaller in diameter than the through holes 11. Alternatively, the diameter of the through holes 48 may be identical to the diameter of the through holes 11. In this case, when the terminals 20 are integrated into the secondary molded portion 42 by insert molding, the terminals 20 are held by members other than the pedestal portion 47.

In the foregoing embodiment, the terminals 20 are positioned by forming the two pedestal portions 47 and 49. Alternatively, the terminals 20 may be positioned by forming three or more pedestal portions.

INDUSTRIAL APPLICABILITY

The present invention is preferably suited to an electric connector including a plate-like fitting part to fit the counterpart connector.

DESCRIPTION OF REFERENCE SIGNS

1 Electric connector
2 Main body part
3 Inner shield member
4 Outer shield member
5 Opening
6 Lock portion
7 Leg portion
10 Screen plate
11 Through hole
12 Leg portion
13 Shoulder portion
14 Through hole
15 Concave portion
16 Through hole
20 Terminal
20*a* Power supply minus terminal
20*b* Power supply plus terminal
20*c* High-speed transmission terminal
20*d* High-speed transmission terminal
20*e* High-speed transmission terminal
20*f* High-speed transmission terminal
21 Connection portion
21*c* Connection portion
21*d* Connection portion
21*e* Connection portion
21*f* Connection portion
22 Terminal portion
30 Terminal
30*a* Power supply minus terminal
30*b* Power supply plus terminal
30*c* High-speed transmission terminal
30*d* High-speed transmission terminal
30*e* High-speed transmission terminal
30*f* High-speed transmission terminal
32 Terminal portion
40 Housing
41 Primary molded portion
42 Secondary molded portion
43 Bulkhead portion
44 Through hole
45 Through hole
46 Burr prevention portion
47 Pedestal portion
48 Through hole
49 Pedestal portion
50 Fitting part
51 Concave portion
52 Positioning portion
52*a* Concave portion
53 EMI pad
70 Press-fit hole

The invention claimed is:

1. An electric connector comprising:

an insulating housing that includes a plate-like fitting part to fit to a counterpart connector;

a plurality of first conductive terminals that is provided in the housing and has a first connection portion arranged on one surface of the fitting part for connection with the counterpart connector and a first terminal portion protruding from the housing;

a plurality of second conductive terminals that is provided in the housing and has a second connection portion arranged on a surface opposite to the one surface of the fitting part for connection with the counterpart connector and a second terminal portion protruding from the housing;

a plate-like screen plate that is interposed between the first connection portion and the second connection portion at the fitting part; and a shield member that is attached to the housing, wherein the housing comprises a primary molded portion in which the plurality of first terminals and the screen plate are integrally provided by insert molding and a secondary molded portion in which the primary molded portion and the plurality of second terminals are integrally provided by insert molding.

2. The electric connector according to claim 1, wherein the screen plate includes a first through hole that penetrates in a thickness direction, the fitting part includes a second through hole that penetrates in the thickness direction through the first through hole and has a diameter equal to or smaller than a diameter of the first through hole, the first connection portion blocks one side of the second through hole in the thickness direction, and the second connection portion blocks the other side of the second through hole in the thickness direction.

3. The electric connector according to claim 2, wherein the second through hole is formed by extracting a fixing pin that fixes the first terminal at the time of insert molding at which the first terminal is integrated into the primary molded portion.

4. The electric connector according to claim 1, wherein the screen plate includes a first through hole that penetrates in a thickness direction, the primary molded portion includes a pedestal portion that penetrates through the first through hole and protrude in a direction away from the first connection portion, and the secondary molded portion is integrally provided with the plurality of second terminals in which the second connection portion is placed on the pedestal portion.

5. The electric connector according to claim 2, wherein the plurality of first terminals or the plurality of second terminals includes a pair of high-speed transmission terminals that transmits signals at a predetermined speed or faster, the first connection portions or the second connection portions of the pair of high-speed transmission terminals are positioned symmetrically with respect to a virtual plane parallel to the thickness direction and orthogonal to the direction of arrangement of the first connection portions and the second connection portions, and the first through hole is positioned symmetrically with respect to the virtual plane.

6. The electric connector according to claim 1, wherein the secondary molded portion includes an inversely-tapered burr preventive portion that fits to the primary molded portion.

7. A method of manufacturing the electric connector according to claim 1, comprising:

forming the primary molded portion in which the plurality of first terminals and the screen plate are integrally provided by insert molding; and forming the secondary molded portion in which the primary molded portion and the plurality of second terminals are integrally provided by insert molding.

8. A method of manufacturing an electric connector comprising:

an insulating housing that includes a plate-like fitting part to fit to a counterpart connector;

a plurality of first conductive terminals that is provided in the housing and has a first connection portion arranged on one surface of the fitting part for connection with the counterpart connector and a first terminal portion protruding from the housing;

a plurality of second conductive terminals that is provided in the housing and has a second connection portion arranged on a surface opposite to the one surface of the fitting part for connection with the counterpart connector and a second terminal portion protruding from the housing;

a plate-like screen plate that is interposed between the first connection portion and the second connection portion of the fitting part; and a shield member that is attached to the housing, the method comprising:

forming a primary molded portion in which the plurality of first terminals and the screen plate are integrally provided by insert molding; and forming a secondary molded portion in which the primary molded portion and the plurality of second terminals are integrally provided by insert molding to provide the housing.

* * * * *